US007956025B2

(12) United States Patent
Copete Vidal et al.

(10) Patent No.: US 7,956,025 B2
(45) Date of Patent: Jun. 7, 2011

(54) FINISHED FIBERS AND TEXTILES

(75) Inventors: Terese Copete Vidal, Sant Cugat del Vallès (ES); Rafael Pi Subirana, Granollers (ES); Anna Tacies Capdevila, Barcelona (ES)

(73) Assignee: Cognis IP Management GmbH, Duesseldorf (DE)

( * ) Notice: Subject to any disclaimer, the term of this patent is extended or adjusted under 35 U.S.C. 154(b) by 534 days.

(21) Appl. No.: 10/512,742

(22) PCT Filed: Apr. 22, 2003

(86) PCT No.: PCT/EP03/04142

§ 371 (c)(1), (2), (4) Date: Oct. 27, 2004

(87) PCT Pub. No.: WO03/093571

PCT Pub. Date: Nov. 13, 2003

(65) Prior Publication Data

US 2005/0150056 A1 Jul. 14, 2005

(30) Foreign Application Priority Data

Apr. 30, 2002 (EP) ..... 02009718

(51) Int. Cl.
*D06M 23/12* (2006.01)

(52) U.S. Cl. ..... 510/133; 8/115.51; 8/115.6; 252/8.61; 252/8.81; 252/8.91; 428/365; 428/368

(58) Field of Classification Search ..... 8/115.51, 8/115.6; 252/8.61, 8.81, 8.91; 428/365, 428/368; 510/133
See application file for complete search history.

(56) References Cited

U.S. PATENT DOCUMENTS

| | | | | |
|---|---|---|---|---|
| 4,514,461 | A | 4/1985 | Woo | |
| 5,432,000 | A * | 7/1995 | Young et al. | 428/372 |
| 6,355,362 | B1 | 3/2002 | Jones et al. | |
| 6,534,091 | B1 | 3/2003 | Garces et al. | |
| 6,733,790 | B1 * | 5/2004 | Garces Garces | 424/497 |
| 2001/0031714 | A1 * | 10/2001 | Gassenmeier et al. | 510/276 |
| 2002/0090398 | A1 * | 7/2002 | Dunn et al. | 424/486 |

FOREIGN PATENT DOCUMENTS

| | | | |
|---|---|---|---|
| DE | 23 18 336 | | 10/1973 |
| EP | 0436729 | * | 2/1991 |
| EP | 0 436 729 | | 7/1991 |
| FR | 2 780 073 | | 12/1999 |
| GB | 2 401 143 | | 7/1975 |
| GB | 1401143 | * | 7/1975 |
| JP | 04 333661 | | 11/1992 |
| JP | 04333661 | * | 11/1992 |
| JP | 11 246383 | | 9/1999 |
| JP | 11246383 | * | 9/1999 |
| JP | 2000 096443 | | 4/2000 |
| JP | 2000096443 | * | 4/2000 |
| WO | 84/02364 | * | 6/1984 |
| WO | WO 01/01926 | | 1/2001 |
| WO | WO 01/01927 | | 1/2001 |
| WO | WO 01/01928 | | 1/2001 |
| WO | WO 01/01929 | | 1/2001 |
| WO | WO0101928 | * | 1/2001 |
| WO | WO 01 98578 | | 12/2001 |

* cited by examiner

*Primary Examiner* — Lorna M Douyon
*Assistant Examiner* — Amina Khan

(57) ABSTRACT

Fibers and fabrics having microcapsules containing active components adhered to the fibers and textiles by a binder material are provided. The fibers and textiles are produced by applying to the fiber and textiles a dispersion containing the microcapsules and the binder.

15 Claims, 1 Drawing Sheet

Fig. 1
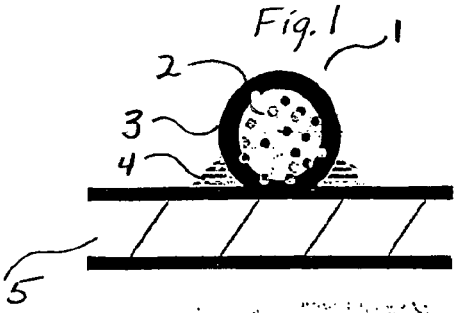
Fig. 2
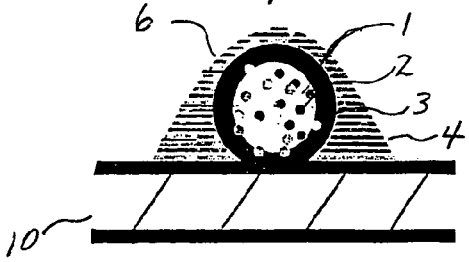
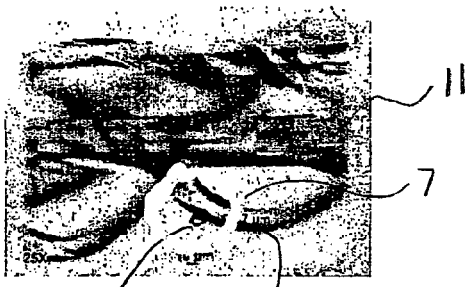
Fig. 3
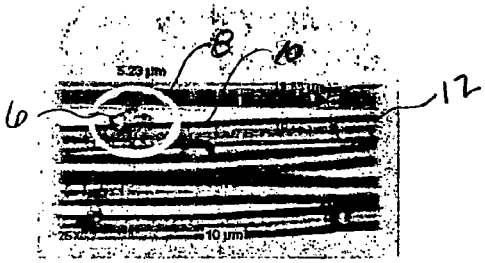
Fig. 4

FINISHED FIBERS AND TEXTILES

RELATED APPLICATIONS

This application is filed under 35 U.S.C. §371 claiming priority from PCT/EP Application Number 03/04142 filed Apr. 22, 2003; claiming priority from EP 02009718.4 filed Apr. 30, 2002, the entire contents of each application are incorporated herein by reference.

FIELD OF THE INVENTION

This invention relates generally to textiles and, more particularly, to new finished fibers and textile fabrics with improved wearing comfort, to processes for their production and to the use of mixtures of microencapsulated active components and binders for textile finishing.

RELATED ART

The term "wearing comfort" encompasses inter alia increased expectations on the part of consumers who are no longer simply content for clothing worn next to the skin, such as lingerie or pantyhose for example, to be comfortable, i.e. not to irritate or redden the skin. On the contrary, consumers also expect such clothing to have a positive effect on the condition of the skin either in both helping to overcome signs of fatigue and imparting a fresh perfume or in avoiding roughness of the skin.

Accordingly, there has been no shortage of attempts to finish textiles and especially ladies' pantyhose—which appears to be a particularly attractive consumer sector—with cosmetic active components which are transferred to the skin during wear and produce the desired effects there. Now, it is quite natural that the desired effects are only developed when the corresponding active component is transferred from the wearer to the skin, i.e. no more active component is present on the item of clothing after it has been worn for a more or less long time. This means that the manufacturer of such products has certain requirements to meet when it comes to selecting the active components because—taking into account performance, the quantities that can be applied and, not least, the costs involved—he has to find a compromise which leads to a product of which the effect can be experienced and for which the consumer is prepared to pay an increased price. Since cosmetic active components with the desired effects are generally expensive and since the finishing of the end products also involves additional costs, it is particularly important to the manufacturer that there is no unwanted loss of active components other than by contact between the finished end product and the skin of the wearer, because this would mean that the additional wearing comfort dearly paid for by the consumer would be effective for a shorter time. A particularly unwanted form of loss of active components occurs in the washing of the fibers and fabrics thus finished. Even though such losses cannot be completely avoided, manufacturers of corresponding products are obviously particularly concerned to apply the active components to the fibers in such a way that they are not easily dissolved or mechanically removed.

Accordingly, instead of the impregnation processes often practised, where the active components are directly applied to the fibers or textiles, the use of microencapsulated active components has grown in significance in recent years. Behind it is the idea of accommodating water-soluble or water-dispersible active components in water-soluble capsules which release the active principles during wear either by controlled release through membrane pores or by mechanical destruction of the membranes. In this way, the losses occurring over the course of many washing cycles can actually be considerably reduced by comparison with the use of non-encapsulated active components. However, the results thus obtained overall have long been unsatisfactory, because the encapsulated active components are only loosely stored between the fiber fibrils and, hence, can easily be washed out during the washing process, for example by mechanical action.

Accordingly, the problem addressed by the present invention was to provide fibers and fabrics finished with active components which would be free from the disadvantages mentioned above, i.e. would display the favorable properties over a large number of wash cycles without significant losses of active components occurring during washing.

BRIEF DESCRIPTION OF THE INVENTION

The present invention relates to special fibers and textile fabrics which are distinguished by the fact that they are finished with mixtures of (a) microencapsulated active components and (b) binders.

It has surprisingly been found that the effect of finishing fibers and textiles with a mixture of microencapsulated active components and binders is that the microcapsules and hence the active components adhere more firmly to the fibers and, accordingly, are not dissolved or washed off as quickly during the washing process as comparably finished end products where the microcapsules do not adhere directly to the fiber fibrils. As a result, finished fibers and textile fabrics are obtained where the additional care effect in relation to conventional products can be noticed for a longer period of time by the consumer both in the case of permanent wear and after the same number of wash cycles.

Whereas commercially available skin care preparations contain on average only 2% by weight of active components, a particular advantage of the fibers and fabrics treated in accordance with the invention is that the microcapsules applied have a very much higher active component content of ca. 20 to 30% by weight.

BRIEF DESCRIPTION OF THE DRAWINGS

FIG. 1 is a diagrammatic representation in cross-section of a fiber with microcapsule attached to the fibers by a single layer of binder.

FIG. 2 is a diagrammatic representation in cross-section of a microcapsule attached to the fiber by a coating.

FIG. 3 is a copy of a photomicrograph of the microcapsule shown in FIG. 1 attached to a fiber.

FIG. 4 is a copy of a photomicrograph of the microcapsule shown in FIG. 2 attached to a fiber.

DESCRIPTION OF THE INVENTION

Active Components

The choice of the active components is basically not critical and depends solely on the particular effect to be achieved on the skin. Preferred active components have moisturizing properties, counteract cellulitis and/or are self-tanning. Typical examples are tocopherol, tocopherol acetate, tocopherol palmitate, carotenes, caffeine, ascorbic acid, (deoxy)ribonucleic acid and fragmentation products thereof, β-glucans, retinol, bisabolol, allantoin, phytantriol, panthenol, AHA acids, amino acids, ceramides, pseudoceramides, chitosan, dihydroxyactone, menthol, squalane, essential oils (for example jojoba oil), vegetable proteins and hydrolysis products thereof, plant extracts, such as for example prunus extract, bambara nut extract, and vitamin complexes. It is particularly preferred to use squalane.
chitosan,
menthol,
retinol (vitamin A),
caffeine,
vegetable proteins and hydrolysis products thereof,
carotenes and
jojoba oil because they contribute towards the equilibrium of the cutaneous hydrolipid layer,
prevent water loss and hence wrinkling,
freshen the skin and counteract signs of fatigue,
give the skin a soft and elastic feel,
improve dermal drainage, the supply of nutrients and the circulation,
act against oxidative stress, environmental toxins, ageing of the skin and free radicals,
compensate for the loss of fats caused by water and sun,
improve the water resistance of UV filters,
guarantee uniform tanning and, finally,
show antimicrobial properties.

The percentage content of active components in the microcapsules may be between 1 and 30% by weight and is preferably from 5 to 25% by weight and more particularly from 15 to 20% by weight.

Microcapsules

"Microcapsules" are understood by the expert to be spherical aggregates with a diameter of about 0.0001 to about 5 mm which contain at least one solid or liquid core surrounded by at least one continuous membrane. More precisely, they are finely dispersed liquid or solid phases coated with film-forming polymers, in the production of which the polymers are deposited onto the material to be encapsulated after emulsification and coacervation or interfacial polymerization. In another process, liquid active substances are absorbed in a matrix ("microsponge") which, as microparticles, may be additionally coated with film-forming polymers. The microscopically small capsules, also known as nanocapsules, can be dried in the same way as powders. Besides single-core microcapsules, there are also multiple-core aggregates, also known as microspheres, which contain two or more cores distributed in the continuous membrane material. In addition, single-core or multiple-core microcapsules may be surrounded by an additional second, third etc. membrane. The membrane may consist of natural, semisynthetic or synthetic materials. Natural membrane materials are, for example, gum arabic, agar agar, agarose, maltodextrins, alginic acid and salts thereof, for example sodium or calcium alginate, fats and fatty acids, cetyl alcohol, collagen, chitosan, lecithins, gelatin, albumin, shellac, polysaccharides, such as starch or dextran, polypeptides, protein hydrolyzates, sucrose and waxes. Semisynthetic membrane materials are inter alia chemically modified celluloses, more particularly cellulose esters and ethers, for example cellulose acetate, ethyl cellulose, hydroxypropyl cellulose, hydroxypropyl methyl cellulose and carboxymethyl cellulose, and starch derivatives, more particularly starch ethers and esters. Synthetic membrane materials are, for example, polymers, such as polyacrylates, polyamides, polyvinyl alcohol or polyvinyl pyrrolidone.

Examples of known microcapsules are the following commercial products (the membrane material is shown in brackets) Hallcrest Microcapsules (gelatin, gum arabic), Coletica Thalaspheres (maritime collagen), Lipotec Millicapseln (alginic acid, agar agar), Induchem Unispheres (lactose, microcrystalline cellulose, hydroxypropylmethyl cellulose), Unicerin C30 (lactose, microcrystalline cellulose, hydroxypropylmethyl cellulose), Kobo Glycospheres (modified starch, fatty acid esters, phospholipids), Softspheres (modified agar agar), Kuhs Probiol Nanospheres (phospholipids), Primaspheres and Primasponges (chitosan, alginates) and Primasys (phospholipids).

Chitosan microcapsules and processes for their production are the subject of earlier patent applications filed by applicants [WO 01/01926, WO 01/01927, WO 01/01928, WO 01/01929]. Microcapsules with mean diameters of 0.0001 to 5, preferably 0.001 to 0.5 and more particularly 0.005 to 0.1 mm, which consist of a membrane and a matrix containing the active components, may be obtained, for example, by (a1) preparing a matrix from gel formers, chitosans and active components, (a2) optionally dispersing the matrix in an oil phase and (a3) treating the optionally dispersed matrix with aqueous solutions of anionic polymers and optionally removing the oil phase in the process or (b1) preparing a matrix from gel formers, anionic polymers and active components, (b2) optionally dispersing the matrix in an oil phase and (b3) treating the optionally dispersed matrix with aqueous chitosan solutions and optionally removing the oil phase in the process or (c1) processing aqueous active-component preparations with oil components in the presence of emulsifiers to form o/w emulsions, (c2) treating the emulsions thus obtained with aqueous solutions of anionic polymers, (c3) contacting the matrix thus obtained with aqueous chitosan solutions and (c4) removing the encapsulated products thus obtained from the aqueous phase.

Gel Formers

Preferred gel formers for the purposes of the invention are substances which are capable of forming gels in aqueous solution at temperatures above 40° C. Typical examples of such gel formers are heteropolysaccharides and proteins. Preferred thermogelling heteropoly-saccharides are agaroses which may be present in the form of the agar agar obtainable from red algae, even together with up to 30% by weight of non-gel-forming agaropectins. The principal constituent of agaroses are linear polysaccharides of D-galactose and 3,6-anhydro-L-galactose with alternate β-1,3- and β-1,4-glycosidic bonds. The heteropolysaccharides preferably have a molecular weight of 110,000 to 160,000 and are both odorless and tasteless. Suitable alternatives are pectins, xanthans (including xanthan gum) and mixtures thereof. Other preferred types are those which—in 1% by weight aqueous solution—still form gels that do not melt below 80° C. and solidify again above 40° C. Examples from the group of thermogelling proteins are the various gelatins.

Chitosans

Chitosans are biopolymers which belong to the group of hydrocolloids. Chemically, they are partly deacetylated chitins differing in their molecular weights which contain the following—idealized—monomer unit:

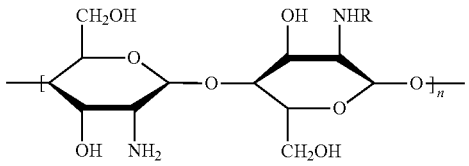

In contrast to most hydrocolloids, which are negatively charged at biological pH values, chitosans are cationic biopolymers under these conditions. The positively charged chitosans are capable of interacting with oppositely charged surfaces and are therefore used in cosmetic hair-care and body-care products and pharmaceutical preparations. Chitosans are produced from chitin, preferably from the shell residues of crustaceans which are available in large quantities as inexpensive raw materials. In a process described for the first time by Hackmann et al., the chitin is normally first deproteinized by addition of bases, demineralized by addition of mineral acids and, finally, deacetylated by addition of strong bases, the molecular weights being distributed over a broad spectrum. Preferred types are those which have an average molecular weight of 10,000 to 500,000 dalton or 800,000 to 1,200,000 dalton and/or a Brookfield viscosity (1% by weight in glycolic acid) below 5,000 mPas, a degree of deacetylation of 80 to 88% and an ash content of less than 0.3% by weight. In the interests of better solubility in water, the chitosans are generally used in the form of their salts, preferably as glycolates.

Oil Phase

Before formation of the membrane, the matrix may optionally be dispersed in an oil phase. Suitable oils for this purpose are, for example, Guerbet alcohols based on fatty alcohols containing 6 to 18 and preferably 8 to 10 carbon atoms, esters of linear $C_{6-22}$ fatty acids with linear $C_{6-22}$ fatty alcohols, esters of branched $C_{6-13}$ carboxylic acids with linear $C_{6-22}$ fatty alcohols such as, for example, myristyl myristate, myristyl palmitate, myristyl stearate, myristyl isostearate, myristyl oleate, myristyl behenate, myristyl erucate, cetyl myristate, cetyl palmitate, cetyl stearate, cetyl isostearate, cetyl oleate, cetyl behenate, cetyl erucate, stearyl myristate, stearyl palmitate, stearyl stearate, stearyl isostearate, stearyl oleate, stearyl behenate, stearyl erucate, isostearyl myristate, isostearyl palmitate, isostearyl stearate, isostearyl isostearate, isostearyl oleate, isostearyl behenate, isostearyl oleate, oleyl myristate, oleyl palmitate, oleyl stearate, oleyl isostearate, oleyl oleate, oleyl behenate, oleyl erucate, behenyl myristate, behenyl palmitate, behenyl stearate, behenyl isostearate, behenyl oleate, behenyl behenate, behenyl erucate, erucyl myristate, erucyl palmitate, erucyl stearate, erucyl isostearate, erucyl oleate, erucyl behenate and erucyl erucate. Also suitable are esters of linear $C_{6-22}$ fatty acids with branched alcohols, more particularly 2-ethyl hexanol, esters of hydroxycarboxylic acids with linear or branched $C_{6-22}$ fatty alcohols, more especially Dioctyl Malate, esters of linear and/or branched fatty acids with polyhydric alcohols (for example propylene glycol, dimer diol or trimer triol) and/or Guerbet alcohols, triglycerides based on $C_{6-10}$ fatty acids, liquid mono-/di-/triglyceride mixtures based on $C_{6-18}$ fatty acids, esters of $C_{6-22}$ fatty alcohols and/or Guerbet alcohols with aromatic carboxylic acids, more particularly benzoic acid, esters of $C_{2-12}$ dicarboxylic acids with linear or branched alcohols containing 1 to 22 carbon atoms or polyols containing 2 to 10 carbon atoms and 2 to 6 hydroxyl groups, vegetable oils, branched primary alcohols, substituted cyclohexanes, linear and branched $C_{6-22}$ fatty alcohol carbonates, Guerbet carbonates, esters of benzoic acid with linear and/or branched $C_{6-22}$ alcohols (for example Finsolv® TN), linear or branched, symmetrical or nonsymmetrical dialkyl ethers containing 6 to 22 carbon atoms per alkyl group, ring opening products of epoxidized fatty acid esters with polyols, silicone oils and/or aliphatic or naphthenic hydrocarbons, for example squalane, squalene or dialkyl cyclohexanes.

Anionic Polymers

The function of the anionic polymers is to form membranes with the chitosans. Preferred anionic polymers are salts of alginic acid. The alginic acid is a mixture of carboxyl-containing polysaccharides with the following idealized monomer unit:

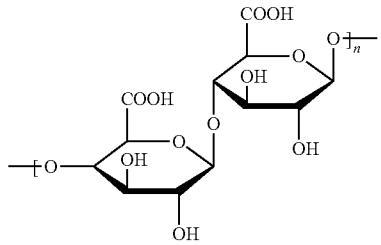

The average molecular weight of the alginic acid or the alginates is in the range from 150,000 to 250,000. Salts of alginic acid and complete and partial neutralization products thereof are understood in particular to be the alkali metal salts, preferably sodium alginate ("algin"), and the ammonium and alkaline earth metal salts. Mixed alginates, for example sodium/magnesium or sodium/calcium alginates, are particularly preferred. In an alternative embodiment of the invention, however, anionic chitosan derivatives, for example carboxylation and above all succinylation products are also suitable for this purpose. Alternatively, poly(meth)acrylates with average molecular weights of 5,000 to 50,000 dalton and the various carboxymethyl celluloses may also be used. Instead of the anionic polymers, anionic surfactants or low molecular weight inorganic salts, such as pyrophosphates for example, may also be used for forming the membrane.

Emulsifiers

Suitable emulsifiers are, for example, nonionic surfactants from at least one of the following groups:

- products of the addition of 2 to 30 mol ethylene oxide and/or 0 to 5 mol propylene oxide onto linear $C_{8-22}$ fatty alcohols, $C_{1222}$ fatty acids and alkyl phenols containing 8 to 15 carbon atoms in the alkyl group and alkylamines containing 8 to 22 carbon atoms in the alkyl group;
- alkyl and/or alkenyl oligoglycosides containing 8 to 22 carbon atoms in the alkyl group and ethoxylated analogs thereof;
- addition products of 1 to 15 mol ethylene oxide onto castor oil and/or hydrogenated castor oil;
- addition products of 15 to 60 mol ethylene oxide onto castor oil and/or hydrogenated castor oil;
- partial esters of glycerol and/or sorbitan with unsaturated, linear or saturated, branched fatty acids containing 12 to 22 carbon atoms and/or hydroxycarboxylic acids containing 3 to 18 carbon atoms and addition products thereof with 1 to 30 mol ethylene oxide;
- partial esters of polyglycerol (average degree of self-condensation 2 to 8), polyethylene glycol (molecular weight 400 to 5,000), trimethylolpropane, pentaerythritol, sugar alcohols (for example sorbitol), alkyl glucosides (for example methyl glucoside, butyl glucoside, lauryl glucoside) and polyglucosides (for example cellulose) with saturated and/or unsaturated, linear or branched fatty acids containing 12 to 22 carbon atoms and/or hydroxycarboxylic acids containing 3 to 18 carbon atoms and addition products thereof with 1 to 30 mol ethylene oxide;

mixed esters of pentaerythritol, fatty acids, citric acid and fatty alcohol and/or mixed esters of fatty acids containing 6 to 22 carbon atoms, methyl glucose and polyols, preferably glycerol or polyglycerol;

mono-, di- and trialkyl phosphates and mono-, di- and/or tri-PEG-alkyl phosphates and salts thereof;

wool wax alcohols;

polysiloxane/polyalkyl/polyether copolymers and corresponding derivatives;

block copolymers, for example Polyethyleneglycol-30 Dipolyhydroxy-stearate;

polymer emulsifiers, for example Pemulen types (TR-1), TR-2) from Goodrich;

polyalkylene glycols and glycerol carbonate.

Ethylene Oxide Addition Products

The addition products of ethylene oxide and/or propylene oxide onto fatty alcohols, fatty acids, alkylphenols or onto castor oil are known commercially available products. They are homolog mixtures of which the average degree of alkoxylation corresponds to the ratio between the quantities of ethylene oxide and/or propylene oxide and substrate with which the addition reaction is carried out. $C_{12/18}$ fatty acid monoesters and diesters of addition products of ethylene oxide with glycerol are known as lipid layer enhancers for cosmetic formulations.

Alkyl and/or alkenyl oligoglycosides

Alkyl and/or alkenyl oligoglycosides, their production and their use are known from the prior art. They are produced in particular by reacting glucose or oligosaccharides with primary alcohols containing 8 to 18 carbon atoms. So far as the glucoside unit is concerned, both monoglycosides in which a cyclic sugar unit is attached to the fatty alcohol by a glycoside bond and oligomeric glycosides with a degree of oligomerization of preferably up to about 8 are suitable. The degree of oligomerization is a statistical mean value on which the homolog distribution typical of such technical products is based.

Partial Glycerides

Typical examples of suitable partial glycerides are hydroxystearic acid monoglyceride, hydroxystearic acid diglyceride, isostearic acid monoglyceride, isostearic acid diglyceride, oleic acid monoglyceride, oleic acid diglyceride, ricinoleic acid monoglyceride, ricinoleic acid diglyceride, linoleic acid monoglyceride, linoleic acid diglyceride, linolenic acid monoglyceride, linolenic acid diglyceride, erucic acid monoglyceride, erucic acid diglyceride, tartaric acid monoglyceride, tartaric acid diglyceride, citric acid monoglyceride, citric acid diglyceride, malic acid monoglyceride, malic acid diglyceride and technical mixtures thereof which may still contain small quantities of triglyceride from the production process. Addition products of 1 to 30 and preferably 5 to 10 mol ethylene oxide onto the partial glycerides mentioned are also suitable.

Sorbitan Esters

Suitable sorbitan esters are sorbitan monoisostearate, sorbitan sesquiisostearate, sorbitan diisostearate, sorbitan triisostearate, sorbitan monooleate, sorbitan sesquioleate, sorbitan dioleate, sorbitan trioleate, sorbitan monoerucate, sorbitan sesquierucate, sorbitan dierucate, sorbitan trierucate, sorbitan monoricinoleate, sorbitan sesquiricinoleate, sorbitan diricinoleate, sorbitan triricinoleate, sorbitan monohydroxystearate, sorbitan sesquihydroxystearate, sorbitan dihydroxystearate, sorbitan trihydroxystearate, sorbitan monotartrate, sorbitan sesquitartrate, sorbitan ditartrate, sorbitan tritartrate, sorbitan monocitrate, sorbitan sesquicitrate, sorbitan dicitrate, sorbitan tricitrate, sorbitan monomaleate, sorbitan sesquimaleate, sorbitan dimaleate, sorbitan trimaleate and technical mixtures thereof. Addition products of 1 to 30 and preferably 5 to 10 mol ethylene oxide onto the sorbitan esters mentioned are also suitable.

Polyglycerol Esters

Typical examples of suitable polyglycerol esters are Polyglyceryl-2 Dipolyhydroxystearate (Dehymuls® PGPH), Polyglycerin-3-Diisostearate (Lameform® TGI), Polyglyceryl-4 Isostearate (Isolan® GI 34), Polyglyceryl-3 Oleate, Diisostearoyl Polyglyceryl-3 Diisostearate (Isolan® PDI), Polyglyceryl-3 Methylglucose Distearate (Tego Care® 450), Polyglyceryl-3 Beeswax (Cera Bellina®), Polyglyceryl-4 Caprate (Polyglycerol Caprate T2010/90), Polyglyceryl-3 Cetyl Ether (Chimexane® NL), Polyglyceryl-3 Distearate (Cremophor® GS 32) and Polyglyceryl Polyricinoleate (Admul® WOL 1403), Polyglyceryl Dimerate Isostearate and mixtures thereof. Examples of other suitable polyolesters are the mono-, di- and triesters of trimethylol propane or pentaerythritol with lauric acid, cocofatty acid, tallow fatty acid, palmitic acid, stearic acid, oleic acid, behenic acid and the like optionally reacted with 1 to 30 mol ethylene oxide.

Anionic Emulsifiers

Typical anionic emulsifiers are aliphatic fatty acids containing 12 to 22 carbon atoms, such as, for example, palmitic acid, stearic acid or behenic acid, and dicarboxylic acids containing 12 to 22 carbon atoms, such as, for example, azelaic acid or sebacic acid.

Amphoteric and Cationic Emulsifiers

Other suitable emulsifiers are zwitterionic surfactants. Zwitterionic surfactants are surface-active compounds which contain at least one quaternary ammonium group and at least one carboxylate and one sulfonate group in the molecule. Particularly suitable zwitterionic surfactants are the so-called betaines, such as the N-alkyl-N,N-dimethyl ammonium glycinates, for example cocoalkyl dimethyl ammonium glycinate, N-acylaminopropyl-N,N-dimethyl ammonium glycinates, for example cocoacylaminopropyl dimethyl ammonium glycinate, and 2-alkyl-3-carboxymethyl-3-hydroxyethyl imidazolines containing 8 to 18 carbon atoms in the alkyl or acyl group and cocoacylaminoethyl hydroxyethyl carboxymethyl glycinate. The fatty acid amide derivative known under the CTFA name of Cocamidopropyl Betaine is particularly preferred. Ampholytic surfactants are also suitable emulsifiers. Ampholytic surfactants are surface-active compounds which, in addition to a $C_{8/18}$ alkyl or acyl group, contain at least one free amino group and at least one —COOH— or —$SO_3H$— group in the molecule and which are capable of forming inner salts. Examples of suitable ampholytic surfactants are N-alkyl glycines, N-alkyl propionic acids, N-alkylaminobutyric acids, N-alkyliminodipropionic acids, N-hydroxyethyl-N-alkylamidopropyl glycines, N-alkyl taurines, N-alkyl sarcosines, 2-alkylaminopropionic acids and alkylaminoacetic acids containing around 8 to 18 carbon atoms in the alkyl group. Particularly preferred ampholytic surfactants are N-cocoalkylaminopropionate, cocoacylaminoethyl aminopropionate and $C_{12/18}$ acyl sarcosine. Finally, other suitable emulsifiers are cationic surfactants, those of the esterquat type, preferably methyl-quaternized difatty acid triethanolamine ester salts, being particularly preferred.

Microcapsule Production Process

To produce the microcapsules, a 1 to 10 and preferably 2 to 5% by weight aqueous solution of the gel former, preferably agar agar, is normally prepared and heated under reflux. A second aqueous solution containing the chitosan in quantities of 0.1 to 2 and preferably 0.25 to 0.5% by weight and the active substances in quantities of 0.1 to 25 and preferably 0.25 to 10% by weight is added in the boiling heat, preferably at 80 to 100° C.; this mixture is called the matrix. Accordingly, the charging of the microcapsules with active substances may also comprise 0.1 to 25% by weight, based on the weight of the capsules. If desired, water-insoluble constituents, for example inorganic pigments, may be added at this stage to adjust viscosity, generally in the form of aqueous or aqueous/alcoholic dispersions. In addition, to emulsify or disperse the active substances, it can be useful to add emulsifiers and/or solubilizers to the matrix. After its preparation from gel former, chitosan and active substances, the matrix may optionally be very finely dispersed in an oil phase with intensive shearing in order to produce small particles in the subsequent encapsulation process. It has proved to be particularly advantageous in this regard to heat the matrix to temperatures in the range from 40 to 60° C. while the oil phase is cooled to 10 to 20° C. The actual encapsulation, i.e. formation of the membrane by contacting the chitosan in the matrix with the anionic polymers, takes place in the last, again compulsory step. To this end, it is advisable to wash the matrix optionally dispersed in the oil phase with an aqueous ca. 1 to 50 and preferably 10 to 15% by weight aqueous solution of the anionic polymer and, if necessary, to remove the oil phase either at the same time or afterwards. The resulting aqueous preparations generally have a microcapsule content of 1 to 10% by weight. In some cases, it can be of advantage for the solution of the polymers to contain other ingredients, for example emulsifiers or preservatives. After filtration, microcapsules with a mean diameter of preferably about 1 mm are obtained. It is advisable to sieve the capsules to ensure a uniform size distribution. The microcapsules thus obtained may have any shape within production-related limits, but are preferably substantially spherical. Alternatively, the anionic polymers may also be used for the preparation of the matrix and encapsulation may be carried out with the chitosans.

An alternative process for the production of the microcapsules according to the invention comprises initially preparing an o/w emulsion which, besides the oil component, water and the active components, contains an effective quantity of emulsifier. To form the matrix, a suitable quantity of an aqueous anionic polymer solution is added to this preparation with vigorous stirring. The membrane is formed by addition of the chitosan solution. The entire process preferably takes place at a mildly acidic pH of 3 to 4. If necessary, the pH is adjusted by addition of mineral acid. After formation of the membrane, the pH is increased to a value of 5 to 6, for example by addition of triethanolamine or another base. This results in an increase in viscosity which can be supported by addition of other thickeners such as, for example, polysaccharides, more particularly xanthan gum, guar guar, agar agar, alginates and tyloses, carboxymethyl cellulose and hydroxyethyl cellulose, relatively high molecular weight polyethylene glycol mono- and diesters of fatty acids, polyacrylates, polyacrylamides and the like. Finally, the microcapsules are separated from the aqueous phase, for example by decantation, filtration or centrifuging.

Binders

The binders suitable for use in accordance with the invention may be selected from the group consisting of (b1) polymeric melamine compounds,
(b2) polymeric glyoxal compounds,
(b3) polymeric silicone compounds,
(b4) epichlorohydrin-crosslinked polyamidoamines,
(b5) poly(meth)acrylates,
(b6) polyalkylene glycols and
(b7) polymeric fluorocarbons.

Whereas binders (b1) to (b4) are preferably used for the production of microencapsulated active component preparations with which the fibers or textile fabrics are impregnated, binders (b5) to (b7) are preferred for preparations applied by pressure application.

Polymeric Melamine Compounds

Melamine (synonym: 2,4,6-triamino-1,3,5-triazine) is normally formed by trimerization of dicyanodiamide or by cyclization of urea with elimination of carbon dioxide and ammonia in accordance with the following equation:

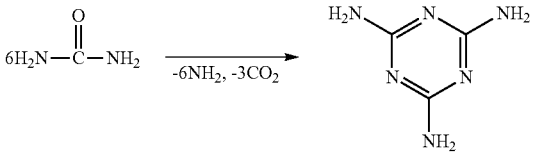

Melamines in the context of the invention are understood to be oligomeric or polymeric condensation products of melamine with formaldehyde, urea, phenol or mixtures thereof.

Polymeric Glyoxal Compounds

Glyoxal (synonym: oxaldehyde, ethanedial) is formed in the vapor-phase oxidation of ethylene glycol with air in the presence of silver catalysts. Glyoxals in the context of the present invention are understood to be the self-condensation products of glyoxal ("polyglyoxals").

Polymeric Silicone Compounds

Suitable silicone compounds are, for example, dimethyl polysiloxanes, methylphenyl polysiloxanes, cyclic silicones and amino-, fatty acid-, alcohol-, polyether-, epoxy-, fluorine-, glycoside- and/or alkyl-modified silicone compounds which may be both liquid and resin-like at room temperature. Other suitable silicone compounds are simethicones which are mixtures of dimethicones with an average chain length of 200 to 300 dimethylsiloxane units and hydrogenated silicates.

Epichlorohydrin-Crosslinked Polyamidoamines

Epichlorohydrin-crosslinked polyamidoamines, which are also known as "fibrabones" or "wet strength resins", are sufficiently well-known from textile and paper technology. They are preferably produced by one of the following two methods:

i) polyaminoamides are (a) initially reacted with a quantity of 5 to 30 mol-%, based on the nitrogen available for quaternization, of a quaternizing agent and (b) the resulting quaternized polyaminoamides are then crosslinked with a molar quantity of epichlorohydrin corresponding to the content of non-quaternized nitrogen, or ii) polyaminoamides are (a) initially reacted at 10 to 35° C. with a quantity of 5 to 40 mol-%, based on the nitrogen available for crosslinking, of epichlorohydrin and (b) the intermediate product is adjusted to a pH of 8 to 11 and crosslinked at 20 to 45° C. with more epichlorohydrin so that the overall molar ratio is 90 to 125 mol-%, based on the nitrogen available for crosslinking.

Poly(meth)acrylates

Poly(meth)acrylates are understood to be homo- and copolymerization products of acrylic acid, methacrylic acid and optionally esters thereof, particularly with lower alcohols, such as for example methanol, ethanol, isopropyl alcohol, the isomeric butanols, cyclohexanol and the like, which are obtained in known manner, for example by radical polymerization in UV light. The average molecular weight of the polymers is typically between 100 and 10,000, preferably between 200 and 5,000 and more particularly between 400 and 2,000 dalton.

Polyalkylene Glycols

Polyalkylene glycols are homo- and copolymerization products of ethylene, propylene and optionally butylene oxide. The condensation of the alkylene oxides may be carried out in known manner in the presence of alkaline catalysts although acidic catalysis is preferred. If mixtures of ethylene and propylene oxide, for example, are used, the polymers may have a block or random distribution. The average molecular weight of the polymers is typically between 100 and 10,000, preferably between 200 and 5,000 and more particularly between 400 and 2,000 dalton.

Quantities Used

The ratio of microcapsules to binder may be from 90:10 to 10:90 and is preferably from 75:25 to 25:75 and more particularly from 60:40 to 40:60 parts by weight. Different forms of adhesion can be achieved according to the production process and the microcapsule-to-binder ratio. Where a smaller quantity of binder is used (for example, ratio by weight of microcapsules to binder >50:50), the microcapsules adhere to the fibrils in a single layer of binder, so that there is direct contact between the membrane and the surface of the skin during wear. It is clear that, with this form of adhesion ("carrier type"), the active component is released very quickly through mechanical friction. If, on the other hand, a larger quantity of binder is used (for example, ratio by weight of microcapsules to binder <50:50), it is generally sufficient not only to bind the microcapsules to the fibers, but also to envelop them or provide them with a coating ("igloo type"). Microcapsules of correspondingly finished fibers are not in direct contact with the skin surface during wear so that, although they are released in smaller quantities, they are active for a longer time (cf. FIGS. 1 and 2). The preparations are generally marketed in the form of aqueous dispersions with a solids content of 5 to 50, preferably 10 to 40 and more particularly 15 to 30% by weight.

FIG. 1 shows in cross-section a microcapsule 1 containing a matrix 2 comprising the active components covered by a membrane 3 attached to a fiber 5 by means of a binder 4. A portion of a fabric 11 containing the attached microcapsule 1 shown in FIG. 1 is shown in FIG. 4. In FIG. 4, the microcapsule is attached to the fiber 5 in the whited circle 7 by a layer of binder.

FIG. 2 shows in cross-section a microcapsule 1 coated with a binder 4 attached to fiber 10. The microcapsule 1 comprising a matrix 2 containing the active material, surrounded by a membrane 3. The microcapsule 1 is surrounded by the binder 4 in an "igloo" shape 6. The microcapsule is attached to the fiber 10 by the binder 4 and the release of the active materials is retarded by the binder 4 which covers the microcapsule.

FIG. 4 shows a portion of a fabric 12 made of fibers 10 having attached thereto the microcapsule 1 encased in the binder 4 in an "igloo" shape 6. The area 8 is represented in FIG. 2.

Commercial Applications

The preparations of microencapsulated active components and binders are used for finishing fibers and all kinds of textile fabrics, i.e. both end products and semifinished products, during or even after the production process in order thus to improve wearing comfort on the skin. The choice of the materials of which the fibers or textiles consist is very largely uncritical. Suitable materials are any standard natural and synthetic materials and blends thereof, but especially cotton, polyamides, polyesters, viscose, polyamide/Lycra, cotton/Lycra and cotton/polyester. The choice of the textile is equally uncritical, although it is logical to finish products which are in direct contact with the skin, i.e. in particular underwear, swimwear, nightwear, hose and pantyhose.

Application Processes

The present invention also relates to a first process for finishing fibers or textile fabrics, in which the substrates are impregnated with aqueous preparations containing the microencapsulated active components and the binders. Impregnation may be carried out, for example, by treating the fibers or textiles with the preparations according to the invention in a commercially available washing machine or by applying the preparations using an immersion bath.

Alternatively, the present invention also relates to a second process for finishing fibers and textile materials in which the aqueous preparations containing the microencapsulated active components and the binders are applied by pressure application. In this process, the fibers/fabrics to be treated are drawn through an immersion bath containing the microencapsulated active components and the binders, the preparations being applied under pressure in a press.

The concentration used is normally from 1 to 90% by weight and preferably from 5 to 60% by weight, based on the liquor or the immersion bath. Impregnation generally requires higher concentrations than pressure application to charge the fibers or textile fabrics with the same amounts of microencapsulated active components.

Finally, the present invention relates to the use of mixtures containing (a) microencapsulated active components and (b) binders for finishing fibers and textile fabrics.

EXAMPLES

Production Example H1

In a 500 ml three-necked flask equipped with a stirrer and reflux condenser, 3 g agar agar were dissolved in 200 ml water in boiling heat. First a homogeneous dispersion of 10 g glycerol and 2 g talcum in ad 100 g water and then a preparation of 25 g chitosan (Hydagen® DCMF, 1% by weight in glycolic acid, Cognis, Düsseldorf/FRG), 5 g squalane, 0.5 g Phenonip® (preservative mixture containing phenoxyethanol and parabens) and 0.5 g Polysorbate-20 (Tween® 20, ICI) in ad 100 g water were added to the mixture over a period of about 30 mins. with vigorous stirring. The matrix obtained was filtered, heated to 60° C. and added dropwise to a 0.5% by weight sodium alginate solution. An aqueous preparation containing 8% by weight microcapsules with a mean diameter of 1 mm was obtained after sieving. Finally, the microcapsules—based on their solids content—were mixed with polyethylene glycol (M=5,000) in a ratio by weight of 40:60.

Production Example H2

In a 500 ml three-necked flask equipped with a stirrer and reflux condenser, 3 g of agar agar were dissolved in 200 ml water in boiling heat. First a homogeneous dispersion of 10 g glycerol and 2 g talcum in ad 100 g water and then a preparation of 25 g chitosan (Hydagen® DCMF, 1% by weight in glycolic acid, Cognis, Düsseldorf/FRG), 5 g tocopherol, 0.5 g Phenonip® (preservative mixture containing phenoxyethanol and parabens) and 0.5 g Polysorbate-20 (Tween® 20, ICI) in ad 100 g water were added to the mixture over a period of about 30 mins. with vigorous stirring. The matrix obtained was filtered, heated to 50° C. and dispersed with vigorous stirring in 2.5 times its volume of paraffin oil cooled beforehand to 15° C. The dispersion was then washed with an aqueous solution containing 1% by weight sodium lauryl sulfate and 0.5% by weight sodium alginate and then repeatedly with a 0.5% by weight aqueous Phenonip solution, the oil phase being removed in the process. An aqueous preparation containing 8% by weight microcapsules with a mean diameter of 1 mm was obtained after sieving. Finally, the microcapsules—based on their solids content—were mixed with polymethacrylate (M=8,000) in a ratio by weight of 50:50.

Production Example H3

In a 500 ml three-necked flask equipped with a stirrer and reflux condenser, 3 g agar agar were dissolved in 200 ml water in boiling heat. First a homogeneous dispersion of 10 g glycerol and 2 g talcum in ad 100 g water and then a preparation of 25 g chitosan (Hydagen® DCMF, 1% by weight in glycolic acid, Cognis, Düsseldorf/FRG), 5 g caffeine, 0.5 g Phenonip® (preservative mixture containing phenoxyethanol and parabens) and 0.5 g Polysorbate-20 (Tween® 20, ICI) in ad 100 g water were added to the mixture over a period of about 30 mins. with vigorous stirring. The matrix obtained was filtered, heated to 60° C. and added dropwise to a 15% by weight solution of Sodium Laureth Sulfate. An aqueous preparation containing 9% by weight microcapsules with a mean diameter of 1 mm was obtained after sieving. Finally, the microcapsules—based on their solids content—were mixed with a melamine/formaldehyde condensate (M=8,000) in a ratio by weight of 50:50.

Production Example H4

In a 500 ml three-necked flask equipped with a stirrer and reflux condenser, 3 g agar agar were dissolved in 200 ml water in boiling heat. First a homogeneous dispersion of 10 g glycerol and 2 g talcum in ad 100 g water and then a preparation of 25 g chitosan (Hydagen® DCMF, 1% by weight in glycolic acid, Cognis, Düsseldorf/FRG), 5 g menthol, 0.5 g Phenonip® (preservative mixture containing phenoxyethanol and parabens) and 0.5 g Polysorbate-20 (Tween® 20, ICI) in ad 100 g water were added to the mixture over a period of about 30 mins. with vigorous stirring. The matrix obtained was filtered, heated to 60° C. and added dropwise to a 15% by weight solution of sodium pyrophosphate. An aqueous preparation containing 8% by weight microcapsules with a mean diameter of 1 mm was obtained after sieving. Finally, the microcapsules—based on their solids content—were mixed with polyethylene glycol (M=5,000) in a ratio by weight of 70:30.

Production Example H5

In a 500 ml three-necked flask equipped with a stirrer and reflux condenser, 3 g of agar agar were dissolved in 200 ml water in boiling heat. First a homogeneous dispersion of 10 g glycerol and 2 g talcum in ad 100 g water and then a preparation of 25 g chitosan (Hydagen® DCMF, 1% by weight in glycolic acid, Cognis, Düsseldorf/FRG), 5 g β-carotene, 0.5 g Phenonip® (preservative mixture containing phenoxyethanol and parabens) and 0.5 g Polysorbate-20 (Tween® 20, ICI) in ad 100 g water were added to the mixture over a period of about 30 mins. with vigorous stirring. The matrix obtained was filtered, heated to 50° C. and dispersed with vigorous stirring in 2.5 times its volume of paraffin oil cooled beforehand to 15° C. The dispersion was then washed with a 15% by weight sodium pyrophosphate solution and then repeatedly with a 0.5% by weight aqueous Phenonip solution, the oil phase being removed in the process. An aqueous preparation containing 10% by weight microcapsules with a mean diameter of 1 mm was obtained after sieving. Finally, the microcapsules—based on their solids content—were mixed with polyethylene glycol (M=5,000) in a ratio by weight of 70:30.

Production Example H6

In a 500 ml three-necked flask equipped with a stirrer and reflux condenser, 3 g gelatin were dissolved in 200 ml water in boiling heat. First a homogeneous dispersion of 10 g glycerol and 2 g talcum in ad 100 g water and then a preparation of 25 g chitosan (Hydagen® DCMF, 1% by weight in glycolic acid, Cognis, Düsseldorf/FRG), 5 g soy protein and 0.5 g Phenonip® in ad 100 g water were added to the mixture over a period of about 30 mins. with vigorous stirring. The matrix obtained was filtered, heated to 60° C. and added dropwise to a 0.5% by weight solution of Hydagen® SCD (succinylated chitosan, Cognis). An aqueous preparation containing 8% by weight microcapsules with a mean diameter of 1 mm was obtained after sieving. Finally, the microcapsules—based on their solids content—were mixed with polyethylene glycol (M=5,000) in a ratio by weight of 70:30.

Production Example H7

In a 500 ml three-necked flask equipped with a stirrer and reflux condenser, 3 g agar agar were dissolved in 200 ml water in boiling heat. First a homogeneous dispersion of 10 g glycerol and 2 g talcum in ad 100 g water and then a preparation of 25 g chitosan (Hydagen® DCMF, 1% by weight in glycolic acid, Cognis, Düsseldorf/FRG), 5 g jojoba oil, 0.5 g Phenonip® (preservative mixture containing phenoxyethanol and parabens) and 0.5 g Polysorbate-20 (Tween® 20, ICI) in ad 100 g water were added to the mixture over a period of about 30 mins. with vigorous stirring. The matrix obtained was filtered, heated to 60° C. and added dropwise to a 0.5% by weight sodium alginate solution. To obtain microcapsules of the same diameter, the preparations were then sieved. Finally, the microcapsules—based on their solids content—were mixed with polyethylene glycol (M=5,000) in a ratio by weight of 70:30.

Production Example H8

In a stirred apparatus, 0.5 g preservative (Phenonip®) was dissolved in 50 g of a 2% by weight aqueous preparation of carboxymethyl cellulose and the mixture was adjusted to pH 3.5. A mixture consisting of 1 g tocopherol and 0.5 g sorbitan monostearate+20EO (Eumulgin® SMS 20, Cognis Deutschland GmbH) was then added with vigorous stirring. A 1% by weight solution of chitosan in glycolic acid (Hydagen® CMF, Cognis Deutschland GmbH) was then added with continued stirring in such a quantity that a chitosan concentration of 0.075% by weight—based on the preparation—was established. The pH was then raised to 5.5 by addition of triethanolamine and the microcapsules formed were decanted.

Finally, the microcapsules—based on their solids content—were mixed with polyethylene glycol (M=5,000) in a ratio by weight of 40:60.

Production Example H9

In a stirred apparatus, 0.5 g preservative (Phenonip®) was dissolved in 50 g of a 2% by weight aqueous preparation of polyacrylic acid (Pemulen® TR-2), a pH of 3 being established. A mixture consisting of 1 g menthol and 0.5 g sorbitan monolaurate+15EO (Eumulgin® SML 15, Cognis Deutschland GmbH) was then added with vigorous stirring. A 1% by weight solution of chitosan in glycolic acid (Hydagen® CMF, Cognis Deutschland GmbH) was then added with continued stirring in such a quantity that a chitosan concentration of 0.01% by weight—based on the preparation—was established. The pH was then raised to 5.5 by addition of triethanolamine and the microcapsules formed were decanted. Finally, the microcapsules—based on their solids content—were mixed with polyethylene glycol (M=5,000) in a ratio by weight of 40:60.

Production Example H10

In a stirred apparatus, 0.5 g preservative (Phenonip®) was dissolved in 50 g of a 2% by weight aqueous preparation of polyacrylic acid (Pemulen® TR-2), a pH of 3 being established. A mixture consisting of 1 g caffeine and 0.5 g Coco Glucosides (Plantacare® APG 1200, Cognis Deutschland GmbH) was then added with vigorous stirring. A 1% by weight solution of chitosan in glycolic acid (Hydagen® CMF, Cognis Deutschland GmbH) was then added with continued stirring in such a quantity that a chitosan concentration of 0.01% by weight—based on the preparation—was established. The pH was then raised to 5.5 by addition of triethanolamine and the microcapsules formed were decanted. Finally, the microcapsules—based on their solids content—were mixed with polyethylene glycol (M=5,000) in a ratio by weight of 40:60.

Application Example 1

Commercially available pantyhose were finished with the microcapsule preparation of Production Example H8 by pressure application and tested for 8 to 48 h by a panel of 30 volunteers. The residual active component content was determined at 8 h intervals. For comparison, the tests were repeated with pantyhose which had been finished with the same microcapsules, but without the added binder. The results are set out in Table 1 and represent the respective mean values.

TABLE 1

Residual active component content as a function of wearing time

| | Wearing time [d] | | | | | | |
|---|---|---|---|---|---|---|---|
| | 0 | 8 | 16 | 24 | 32 | 40 | 48 |
| | Active component content [%-rel] | | | | | | |
| Example H8 | 100 | 90 | 82 | 78 | 72 | 62 | 62 |
| Comparison, no binder | 100 | 80 | 71 | 59 | 40 | 32 | 18 |

It can be seen that the effect of finishing with mixtures of microcapsules and binder is that the active component is released less quickly.

Application Example 2

Commercially available pantyhose were finished with the microcapsule preparation of Production Example H8 by pressure application and washed 30 times (a) in a washing machine (30 mins., 20° C., 1 g/l light-duty detergent) and (b) by hand (15 mins., 20° C., 1 g/l light-duty detergent). The residual active component content after each wash cycle was determined. For comparison, the tests were repeated with pantyhose which had been finished with the same microcapsules, but without the added binder. The results are set out in Table 2.

TABLE 2

Residual active component content as a function of the wash cycles

| | Wash cycles | | | | | | | | | | | | | | |
|---|---|---|---|---|---|---|---|---|---|---|---|---|---|---|---|
| | 0 | 1 | 2 | 3 | 4 | 5 | 6 | 7 | 8 | 9 | 10 | 15 | 20 | 25 | 30 |
| | Active component content [%-rel], machine washing | | | | | | | | | | | | | | |
| Example H8 | 100 | 70 | 58 | 50 | 42 | 40 | 38 | 37 | 33 | 30 | 28 | 22 | 20 | 18 | 16 |
| Comparison, no binder | 100 | 60 | 39 | 21 | 5 | 0 | | | | | | | | | |
| | Active component content [%-rel], hand washing | | | | | | | | | | | | | | |
| Example H8 | 100 | 90 | 88 | 82 | 78 | 76 | 74 | 72 | 71 | 70 | 69 | 52 | 45 | 42 | 41 |
| Comparison, no binder | 100 | 81 | 66 | 51 | 32 | 12 | 3 | 0 | | | | | | | |

It can be seen that the effect of finishing with mixtures of microcapsules and binders is that the active component is washed out less quickly both in machine and in hand washing.

Application Example 3

Commercially available pantyhose were finished with the microcapsule preparation of Production Example H10 by pressure application and tested for 6 h by a panel of 10 volunteers. The hydration of the skin in relation to the untreated condition was then determined with a Corneometer 805 PC. For comparison, the tests were repeated with pantyhose which had been finished with the same microcapsules, but without the added binder. The results are set out in Table 3.

TABLE 3

| | Increase in hydration | | | | | | | | | | |
|---|---|---|---|---|---|---|---|---|---|---|---|
| | Volunteer | | | | | | | | | | |
| | 1 | 2 | 3 | 4 | 5 | 6 | 7 | 8 | 9 | 10 | MW |
| | Increase in hydration [%-rel] | | | | | | | | | | |
| Example H10 | 6 | 14 | 4 | 16 | 14 | 7 | 9 | 7 | 9 | 13 | 10 |
| Comparison, no binder | 5 | 12 | 7 | 8 | 11 | 11 | 4 | 5 | 7 | 10 | 8 |

It can be seen that, on average, a higher degree of hydration was achieved in the case of Example H10 according to the invention.

We claim:

1. A substrate comprising fibers or textile fabrics, finished with a mixture comprising:

(1) microcapsules comprising a membrane and a matrix, said membrane comprising chitosan and said matrix containing an active component having a care effect selected from the group consisting of squalene, chitosan, retinol, caffeine, vegetable proteins, hydrolysis products of vegetable proteins, carotenes and jojoba oils; and (2) a binder selected from the group consisting of polymeric melamine compounds, polymeric glyoxal compounds, polymeric silicone compounds, epichlorohydrin-crosslinked polyamidoamines, polyalkylene glycols, poly(meth)acrylates, polymeric fluorocarbons, and mixtures thereof, wherein the amount of said binder is sufficient to adhere at least a portion of said microcapsules to said fibers or fabric, wherein said microcapsules and said binder are present in the mixture in a ratio by weight of from 75:25 to 25:75, wherein said mixture is applied by pressure application, and wherein said finished fibers or textile fabrics exhibit a care effect from said active component after at least one wear-and-wash cycle.

2. The substrate comprising fibers or textile fabrics as claimed in claim 1, wherein the microcapsules have an active component content of 1 to 30% by weight.

3. The substrate comprising fibers or textile fabrics as claimed in claim 1, wherein the microcapsules have a mean diameter of from 0.0001 to 5 mm.

4. The substrate comprising fibers or textile fabrics of claim 1, wherein said binder comprises a compound selected from the group consisting of polyalkylene glycols, poly(meth) acrylates and polymeric melamine compounds.

5. The substrate comprising fibers or textile fabrics of claim 1, wherein said active component has moisturizing properties.

6. The substrate comprising fibers or textile fabrics of claim 5, wherein said active component comprises caffeine and said binder comprises polyethylene glycol.

7. The substrate comprising fibers or textile fabrics of claim 1 in the form of a garment, wherein said binder is present in an amount such that at least a portion of the microcapsule is not covered by the binder and such that at least a portion of said microcapsule is in direct contact with the skin of the wearer of the garment when the garment is being worn immediately after treatment.

8. The substrate comprising fibers or textile fabrics of claim 1 wherein said binder is present in an amount such that the weight ratio of microcapsule to binder is greater than about 50:50.

9. The substrate comprising fibers or textile fabrics of claim 1 in the form of a garment, wherein said binder is present in an amount such that substantially all of the microcapsule is covered by the binder and such that no substantial portion of said microcapsule is in direct contact with the skin of the wearer of the garment when the garment is being worn immediately after treatment.

10. The substrate comprising fibers or textile fabrics of claim 1 wherein said binder is present in an amount such that the weight ratio of microcapsule to binder is less than about 50:50.

11. The substrate comprising fibers or textile fabrics of claim 1, wherein said microcapsules have a mean diameter of from 0.001 to 0.5 mm.

12. The substrate of claim 1 wherein said active component having a care effect is selected from the group consisting of vegetable proteins, hydrolysis products of vegetable proteins, caffeine and jojoba oils.

13. A method of providing a care effect on skin, comprising the steps of:

(1) providing a substrate comprising fibers and/or textile fabrics, finished with a mixture comprising:

(a) microcapsules comprising a membrane and a matrix, said membrane comprising chitosan and said matrix containing an active component having a care effect selected from the group consisting of squalene, chitosan, retinol, caffeine, vegetable proteins, hydrolysis products of vegetable proteins, carotenes and jojoba oils; and (b) a binder selected from the group consisting of polymeric melamine compounds, polymeric glyoxal compounds, polymeric silicone compounds, epichlorohydrin-crosslinked polyamidoamines, polyalkylene glycols, poly(meth)acrylates, polymeric fluorocarbons, and mixtures thereof, wherein the amount of said binder is sufficient to adhere at least a portion of said microcapsules to said fibers and/or fabric, wherein said microcapsules and said binder are present in the mixture in a ratio by weight of from 75:25 to 25:75, wherein said mixture is applied by pressure application; and (2) wearing said finished substrate, wherein transfer of said active component to the skin provides a care effect from said active component, and wherein said care effect is still exhibited after at least one wear-and-wash cycle.

14. The method of claim 13, wherein said substrate comprising fibers and/or textile fabrics, comprises an end product or semifinished product which is worn in direct contact with the skin.

15. The method of claim 14, wherein said end product or semifinished product is selected from the group consisting of underwear, swimwear, nightwear, hose and pantyhose.

* * * * *